US005336888A

United States Patent [19]

Odom

[11] Patent Number: 5,336,888

[45] Date of Patent: Aug. 9, 1994

[54] HIGH RESOLUTION INFRARED SCENE SIMULATOR

[75] Inventor: Thomas B. Odom, San Dimas, Calif.

[73] Assignee: Aerojet-General Corporation, Rancho Cordova, Calif.

[21] Appl. No.: 923,269

[22] Filed: Jul. 30, 1992

[51] Int. Cl.[5] ..... H01J 43/00

[52] U.S. Cl. ..... 250/495.1; 250/493.1; 250/504 R; 313/386; 313/473

[58] Field of Search ..... 250/495.1, 496.1, 493.1, 250/504 R; 313/380, 388, 364, 386, 461, 473

[56] References Cited

U.S. PATENT DOCUMENTS 4,572,958 2/1986 Durand et al. ..... 250/495.1
4,874,953 10/1989 Katz ..... 250/495.1
4,967,089 10/1990 Reilly et al. ..... 250/496.1
4,999,502 3/1991 Midavaine ..... 250/495.1

*Primary Examiner*—Paul M. Dzierzynski
*Assistant Examiner*—Kiet T. Nguyen
*Attorney, Agent, or Firm*—Leonard Tachner

[57] ABSTRACT

A high resolution infrared scene simulator formed by a novel combination of a photo-cathode, one or more micro-channel plates and a uniquely constructed air-bridge thermal screen. The photo-cathode is used to covert photons into electrons for insertion into the input side of the micro-channel plate. The micro-channel plate is a photo-electric device comprising a parallel array of independent channel, electron multipliers capable of high gain electron amplification. The air-bridge thermal screen comprises numerous thermally isolated thin platelets, bridges or diaphragms whose individual thermal mass and resistance are respectively low and high. Such platelets are thermally isolated and are supported on a structure that is capable of being cooled and electrically conductive.

11 Claims, 6 Drawing Sheets

HIGH RESOLUTION INFRARED SCENE SIMULATOR

BACKGROUND OF THE INVENTION

1. Field of the Invention

The present invention relates generally to the generation of thermal scenes, and more specifically to an apparatus for generating high resolution thermal scenes, primarily used as test targets for the evaluation of near-to-far infrared electro-optical sensors.

2. Prior Art

There are numerous applications for a generator of dynamic, variable intensity, high resolution thermal scenes or patterns. Such a generator would find application in the biomedical field, as well as in secured communications. However, the principal current use for such a generator is for producing test targets for the evaluation of electro-optical sensors in the near to far infrared spectral range. Presently available thermal scene generators utilize resistively heated fibers, filaments or membranes that are typically addressed or powered serially in time. Their construction is usually very labor intensive or extremely process yield sensitive, and consequently, they are very expensive to fabricate. Furthermore, because of their serialized addressing and drive format, their data rates and associated "off target" driver electronics become, large, complex and expensive. An additional significant disadvantage of current thermal scene generators is their inability to operate over large thermal environments, particularly at reduced temperatures between approximately 70 degrees Kelvin and 250 degrees Kelvin, which is an operating requirement for most moderate to low background sensor systems. The prior art known to the applicant includes a number of U.S. Patents of varying degrees of relevance. These patents include the following:

U.S. Pat. No. 3,735,137 Bly
U.S. Pat. No. 4,705,952 Lindmayer
U.S. Pat. No. 4,760,267 Pistor
U.S. Pat. No. 4,769,527 Hart et al
U.S. Pat. No. 4,859,080 Titus et al
U.S. Pat. No. 4,922,116 Grinberg et al
U.S. Pat. No. 4,929,841 Chang
U.S. Pat. No. 4,948,957 Rusche
U.S. Pat. No. 4,967,089 Reilly et al
U.S. Pat. No. 4,999,502 Midavaine
U.S. Pat. No. 5,097,139 Foster The most pertinent of the aforementioned patents may be summarized as follows:

U.S. Patent No. 4,967,089 to Reilly et al is directed to a pulsed optical source for transforming photons of a first wavelength into photoelectrons which are subsequently transformed into photons of a second wavelength. Referring to FIG. 1, there is shown a system wherein photons emitted from a source are converted to electrons by means of a photocathode, the electrons being directed from the photocathode to a multiplying and emitting means. The multiplying means includes a microchannel plate electron multiplier, the electron beam output from which is directed to a phosphor coating whose photon emission can be selected at any wavelength from ultraviolet to infrared, depending upon the particular phosphor selected. However, there is no disclosure of a pixel-by-pixel conversion between the input and output of the device.

U.S. Pat. No. 3,735,137 to Bly is directed to a screen panel for converting an optical image in the visible bandwidth to an infrared image. The screen panel is provided with conductive lattices on opposing sides of a dielectric substrate. The lattices define a matrix of individual cells which in effect define pixels of the resulting scene displayed on the panel. Overlaying the conductors is a resistive layer whose thermal output is responsive to changes in current flowing between the conductors and a conductor disposed within a hole centrally located in each of the pixel representative squares. On the opposing side of the panel a layer of photoconductive material is disposed over the lattice, such that a change in light impinging upon the photoconductive material provides a proportional change in current through the resistive material to thereby provide the respective change in infrared radiation emitted therefrom.

U.S. Pat. Nos. 4,769,527 (Hart et al); 4,859,080 (Titus et al); and 4,922,116 (Grinberg et al) are directed to thermal image display systems. These references disclose devices are of interest in that they provide an infrared display wherein individual pixels are driven to radiate the infrared image.

U.S. Pat. No. 4,929,841 to Chang is directed to a dynamic infrared target. The target is formed by a photo-conductive film deposited on a transparent substrate wherein visible light photons which impinge upon the film through the substrate are absorbed, resulting in redistributing electrons from the valance band to the conductive band of the film to produce an infrared emission. An infrared image is produced by impinging the film with an image from a light projector.

U.S. Pat. No. 4,999,502 to Midavaine is directed to a system for generating an infrared image. As shown in the figures, a screen is mounted to a cathode ray tube for transforming an electron beam into infrared radiation. The screen is defined by a matrix of slabs, separated by a lattice of furrows to define thermal pixels.

In each of the aforementioned prior art patents relevant to the present invention, there is disclosed an infrared scene generator which suffers from one or more disadvantages relating to either extremely expensive construction, relatively low fabrication yield, complex off target drive electronics or the inability to operate over large thermal environments. There is therefore, still an unfilled need for a thermal scene generator which utilizes components and materials that can operate over a large thermal range, thereby obviating thermal background problems. There is also a need for thermal scene generators which are simple in construction and operation and are compatible with low cost production and utilization. Furthermore, there is a need for thermal scene generators which are implemented using parallel processing features so that data rates related to the time delay between visual or photon scene "IN" and thermal scene "OUT" can be extremely high.

SUMMARY OF THE INVENTION

The thermal scene generator of the present invention comprises three major components that are optically and mechanically aligned to one another and are surrounded by a vacuum environment. These components comprise an air bridge thermal screen, at least one micro-channel plate and a photo cathode. The air bridge thermal screen comprises numerous, thermally isolated thin platelets, bridges or diaphragms whose individual thermal mass and resistance are respectively low and high. Typically, such structures are fabricated using silicon technology and photolithographic processes. These thermally isolated platelets are supported on a structure that is capable of being cooled and electrically conductive.

The micro-channel plates are photoelectric devices comprising a parallel array of independent channel electron multipliers capable of high gain electron amplification while maintaining front to back area coherence. A micro-channel plate may be considered to be a coherent fiber optic bundle comprising thousands of fibers whose inner optical core material has been removed and replaced by a hollow channel like, low work function photo-cathode material. During operation, a voltage potential is applied across the micro-channel plate in a direction almost parallel to the channels therein. Electrons or highly energenic photons introduced into the input side of the micro-channel plate generate electrons that in turn, as if by avalanching, generate many more electrons as they are swept along inside the individual micro-channels by the applied field, thereby resulting in a significant electron gain.

The photo-cathode of the present invention is used to convert photons into electrons for insertion into the input side of the micro-channel plate. This element also has a front to back area of coherence, meaning that a visual or photon scene on its input side produces a corresponding scene of variable electron density at its output side. Thus, the combination of photo-cathode and micro-channel plate provide the ability to create coherent and variable high energy density electron streams at the output of the micro-channel plate. This characteristic, when used in conjunction with the air-bridge thermal screen and appropriate voltages and spacings, allow the generation of thermal scenes of patterns on a thermal screen, those scenes or patterns being geometrically or thermally similar to any visual or photon scene incident on the input to the photo-cathode. Thus, in the present invention, the novel combination of a photo-cathode, one or more micro-channel plates and air-bridge thermal screen provides a thermal scene generator which is simple in construction and operation, compatible with low-cost production and utilization, can operate at temperatures below 70 degrees Kelvin, and provide parallel processing high data rates, thereby meeting all of the aforementioned needs not currently served by the prior art.

OBJECTS OF THE INVENTION

It is therefore a principal object of the present invention to provide a thermal scene generator , such as for the generation of test targets for the evaluation of near-to-far infrared electro-optical sensors and which overcomes the aforementioned disadvantages of the prior art.

It is another object of the present invention to provide a dynamic, variable intensity, high resolution thermal scene or pattern generator which is simple to construct and operate, is compatible with low-cost production and utilization, can typically operate at temperatures below 70 degrees Kelvin and utilizes parallel processing for high data rates.

It is still an additional object of the present invention to provide a high resolution thermal scene generator comprising an air-bridge thermal screen, at least one micro-channel plate and a photo-cathode for generating thermal scenes on the thermal screen that are geometrically and/or thermally similar to any visual or photon scene incident on the photo-cathode.

BRIEF DESCRIPTION OF THE DRAWINGS

The aforementioned objects and advantages of the present invention, as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
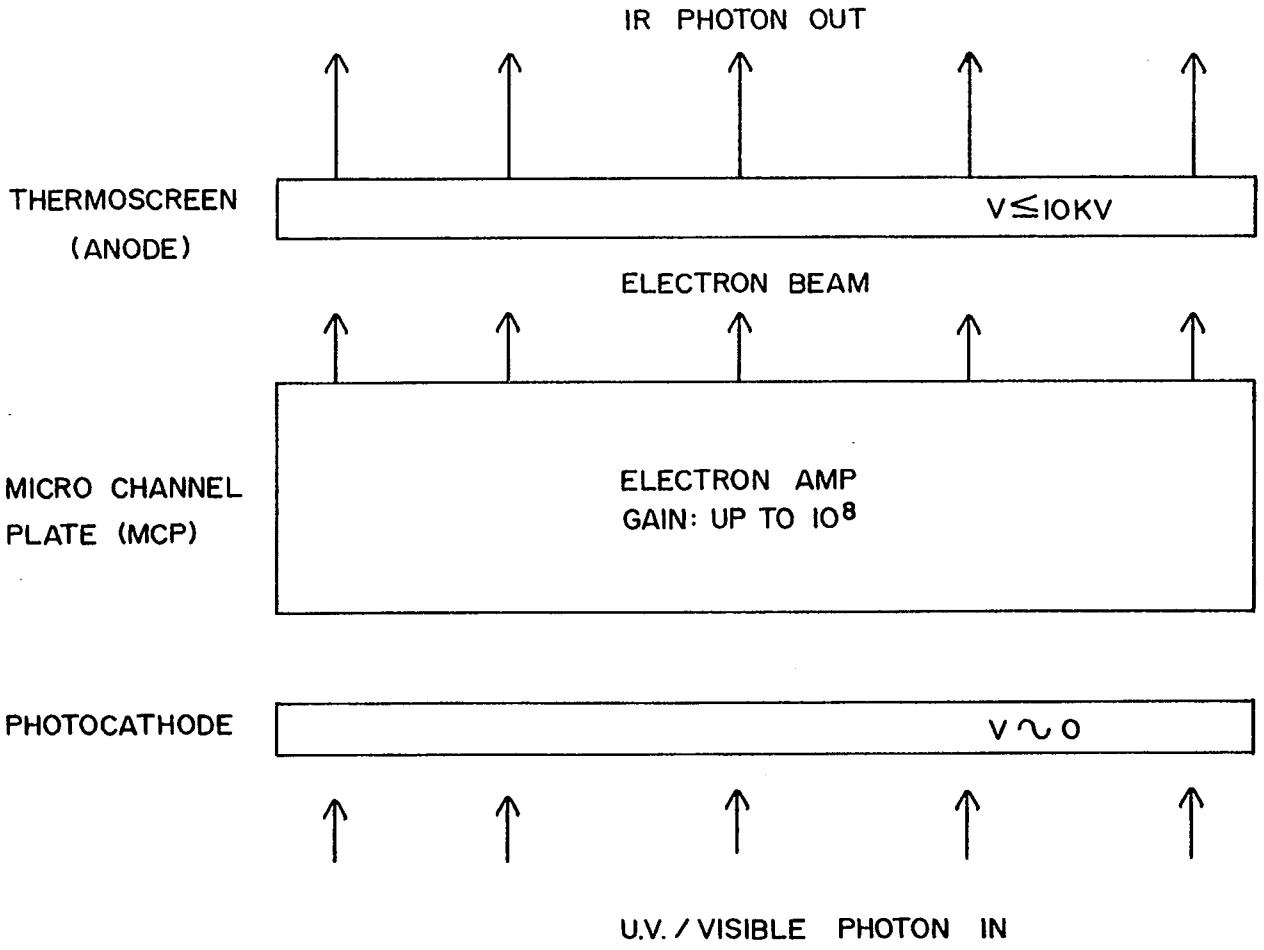
FIG. 1 is a conceptual block diagram of the thermal scene generator of the present invention.

The embodiment of the thermal scene generator of the present invention shown in FIG. 1, comprises three major components that are optically and mechanically aligned to one another and are surrounded by a vacuum environment. These three components comprise an air-bridge thermal screen, at least one micro-channel plate and a photo-cathode. The photo-cathode receives the incoming photons in the form of ultraviolet or visible light. Such photons are converted into electrons for insertion into the input side of the micro-channel plate. Suitable photo-cathodes are commercially available and should be selected for durability and ease of use. One suitable photo-cathode selected for use with the disclosed preferred embodiment is manufactured by Gallaleo Electrooptics Corp.

Figure 2:
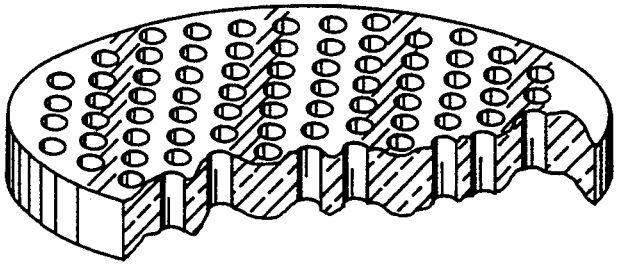
FIG. 2 PRIOR ART
FIG. 2 is a simplified isometric view of a micro-channel plate used in the present invention.
Figure 3:
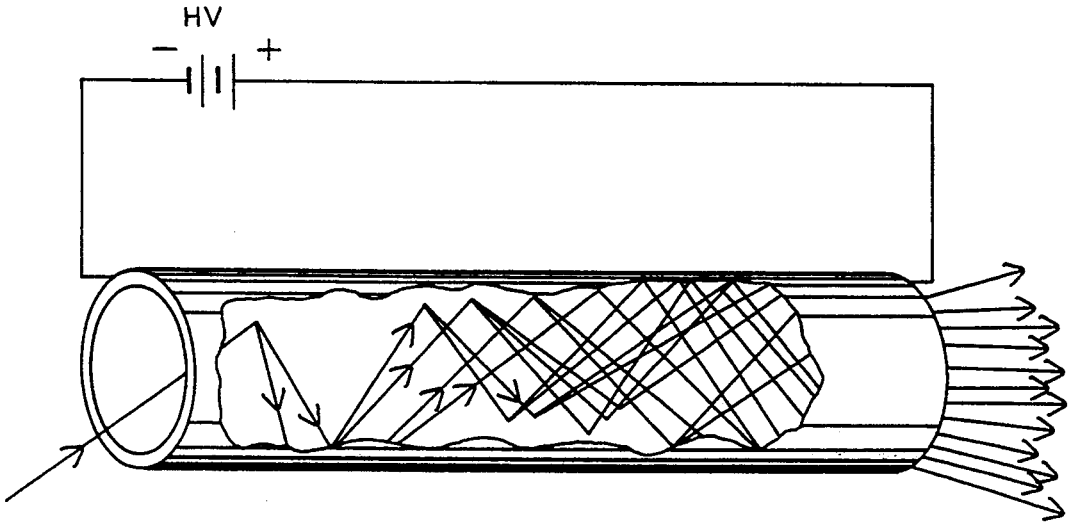
FIG. 3 PRIOR ART
FIG. 3 is a schematic illustration of one channel of a micro-channel plate illustrating the electron gain feature of such a channel.

The micro-channel plate (the disclosed embodiment may utilize plates) provides in a small package, a high electron gain exceeding $10^4$ for a unitary micro-channel plate and exceeding $10^8$ for tandom micro-channel plate operation. The structure and operation of a micro-channel plate are shown in FIGS. 2 and 3, respectively. A micro-channel plate begins fabrication as a glass tube fitted with a solid, acid etchable core and drawn via fiber-optic techniques to form single fibers called mono-fibers. A number of these mono-fibers are stacked in a hexagonal array called a multi. The entire assembly is drawn again to form multi-fibers. The multi-fibers are then stacked to form a boule or billet which is fused together at high temperature. The fused billet is sliced on a wafer saw to the required bias angle, etched to size and then ground and polished to an optical finish. The individual slices are chemically processed to remove the solid core material, leaving a honeycomb structure of millions of tiny holes. Each such hole is capable of functioning as a single channel electron multiplier which is relatively independent of the surrounding channels. Through subsequent processing, this specially formulated glass wafer is given its conductive and secondary emissive properties. Finally, a thin metal electrode (usually Inconel or Nichrome) is vacuum-deposited on both input and output surfaces of the wafer to electrically connect all of the channels in parallel. A cross-sectional diagram of the completed wafer is shown in FIG. 2, which illustrates the major mechanical characteristics of all micro-channel plates.

In this manner, micro-channel plate arrays may be fabricated in a wide variety of formats. The arrays may range in size from 6 millimeters to 150 millimeters or more and they may be circular, rectangular or virtually any other shape that is required by the application or instrument geometry. In addition, a cylindrical or spherical radius of curvature may be provided to conform to the focal plane of an instrument.

Micro-channel plate resolution is determined by channel diameter and center-to-center spacing. Channel diameters ranging from 8 micrometers with a 10 micrometer center-to-center spacing to 25 micrometers with a 32 micrometer center-to-center spacing, are relatively standard. However, for larger plate diameters, for example greater than 40 millimeters and for all rectangular models, 25 micro-channel material is usually used in order to maintain mechanical rigidity. In the preferred embodiment of the present invention, the microchannel plate has an active area of 75 mm or larger, a resolution of 10 $\mu$m center-to-center fiber spacing, a current density of up to 250 $\mu A/cm^2$ and an operating temperature to less than 70 degrees K. A normal operation voltage bias up to 1000 volts is applied across the micro-channel plate with the output at its most positive potential. The bias current flowing through the plate resistance is what supplies the electrons necessary to continue the secondary emission process. This process, as it would occur in a single channel of a standard straight channel micro-channel plate, is illustrated in FIG. 3. When a photon or charged particle is incident at the input of a micro-channel, secondary electrons are generated. Due to the bias applied, these are accelerated down the channel, toward the output end. When they strike the channel walls in route, additional secondary electrons are generated. This process is continuously repeated down the channel, until at the output a pulse of up to 10,000 electrons may be realized. If two or more micro-channel plates are operated in series, a single event will generate a pulse of $10^7$ or more electrons at the output. The output signals typically are collected in any of several ways, including metal or multi-metal anodes, resistive anode encoder or on a phosphor screen deposited on a fiber-optic substrate. In the present invention the electrons are collected by an air-bridge thermal screen, the structure of which will now be explained in conjunction with FIGS. 4 through 10. The air-bridge thermal screen comprises many thermally isolated thin platelets, bridges or diaphragms whose individual thermal mass and resistance are respectively extremely low and high. The air-bridge thermal screen 10 is comprised of three basic components, namely a top thermal bridge layer 12 (top membrane), an isolation spacer 14 (egg-crate shaped spacer) and an optically transparent, yet thermally conductive substrate 16. The thermal bridge top layer 12 must be able to be heated to the temperature required for the operation of the scene simulator. It must also be pixelized so as not to degrade the scene resolution as a result of blooming or thermal spreading. It must also be constructed so that the dominating power loss is radiative and not conductive. To further enhance its performance, it is desirable that the top layer be highly reflective on one side and highly absorptive on the other.

The isolation spacer 14 performs two functions, its structure 11 permits pixelization of the thermal bridge layer and it also thermally isolates the thermal bridge layer from the underlying optical substrate. The optical substrate 16 provides the major structural member for the thermal screen assembly.

Figure 5:
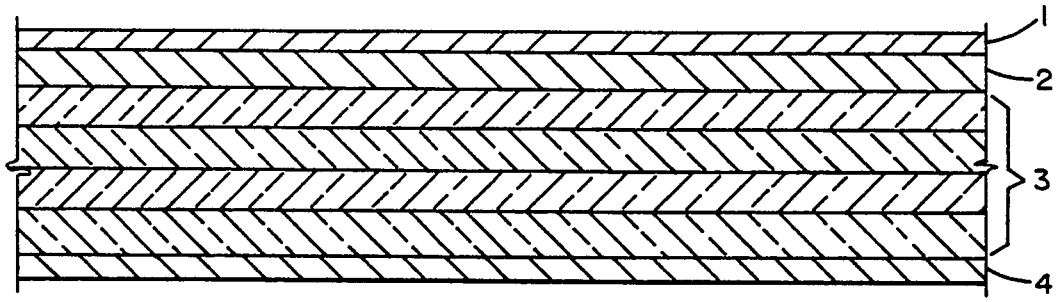
FIG. 5 is a highly enlarged cross-sectional view of a membrane used in the air-bridge thermal screen of the present invention.

The top membrane 12 typically has a thickness of less than 5 microns and is composed of multiple layers of conductive and insulative films, as shown in FIG. 5. The four layers shown in FIG. 5 comprise the following: Layer 1 consists of a 100 to 500 Angstrom thick layer of gold, layer 2 consists of about 1000 Angstrom thickness of Tungsten, layer 3 consists of a 1 micron to 5 micron thickness of various sublayers of Silicon Nitrite/Silicon Oxy-Nitrite and layer 4 consists of approximately a 500 Angstrom thickness of an optically black material having a absorptance of at least 0.8 to 0.9, such as Cupric Oxide.

Figure 6:
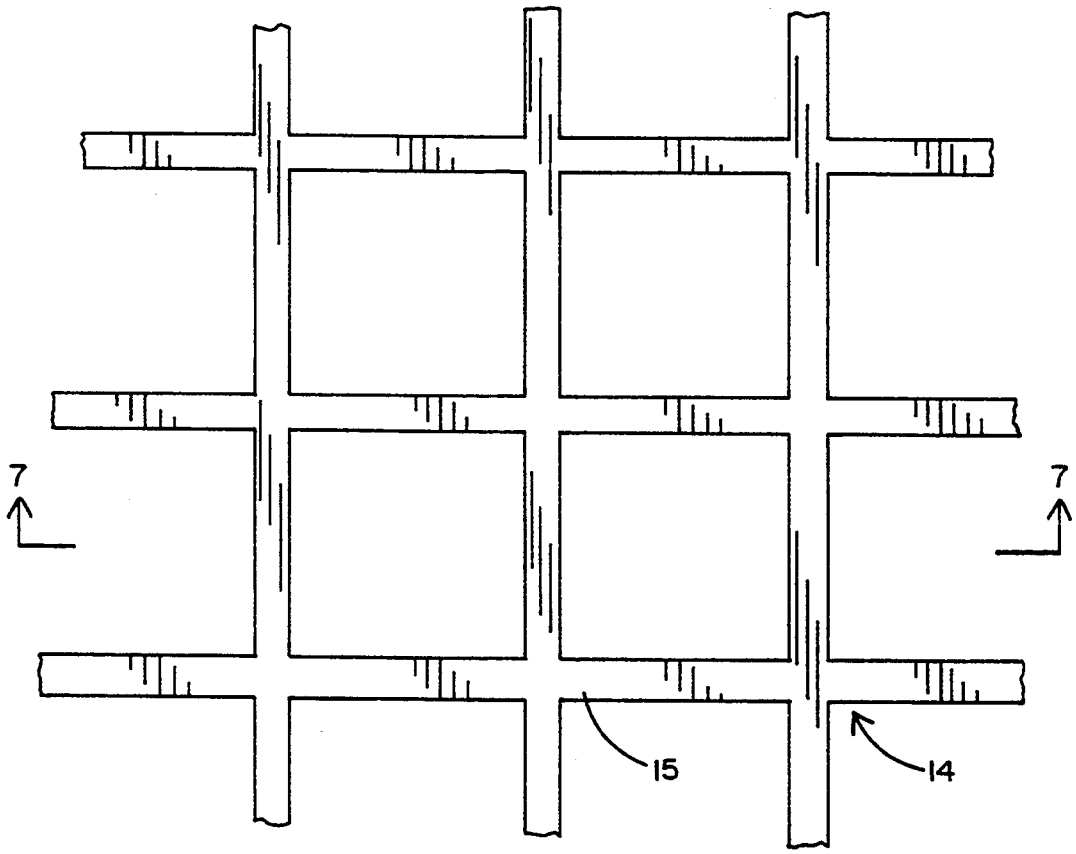
FIG. 6 is a top view of an egg-crate shaped spacer which is used in the air-bridge thermal screen of the present invention.
Figure 7:
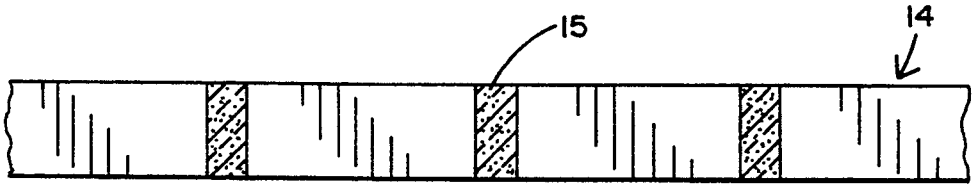
FIG. 7 is a side view of the egg-crate spacer shown in FIG. 6.

The spacer which separates the top membrane from the underlying optically transparent substrate is, in the preferred embodiment disclosed herein, approximately 0.1 millimeters in thickness and is configured into an egg-crate like structure, as shown in top view and side view in FIGS. 6 and 7, respectively. This egg-crate like structure is fabricated by means of wet or dry etching techniques, such as selective chemical etching or plasma techniques, or reactive ion etching and the like. For the design illustrated in FIG. 6, the egg-crate wall thicknesses are approximately 0.01 millimeters and the distance between the egg-crate walls 15 is approximately 0.1 millimeters.

Figure 8:
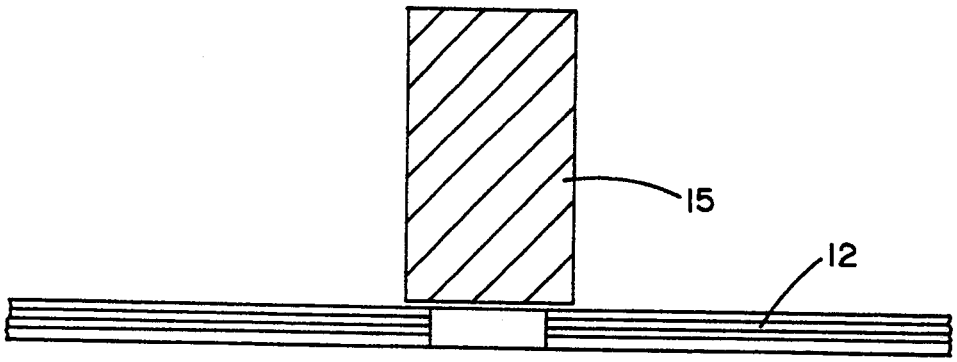
FIG. 8 is a highly enlarged view of the top membrane of the air-bridge thermal screen shown being attached to the egg-crate spacer during the fabrication of the air-bridge thermal screen.
Figure 9:
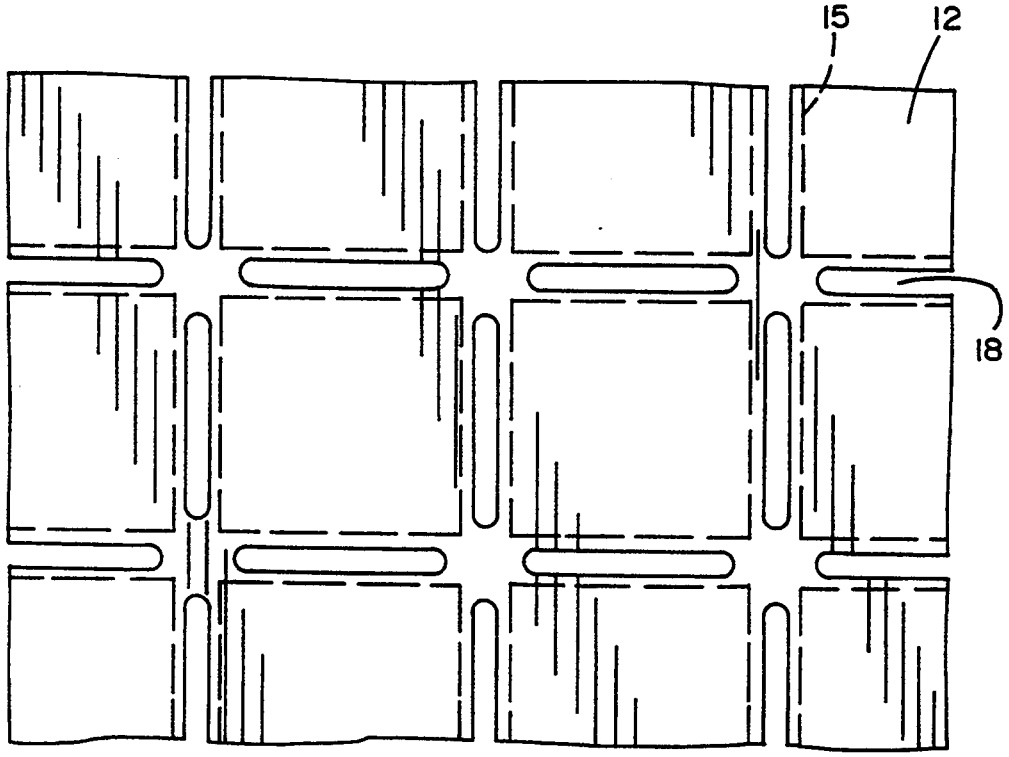
FIG. 9 is a top view of the air-bridge thermal screen after the top membrane has been attached to the underlying egg-crate spacer.

In the preferred fabrication process disclosed herein, the spacer is fabricated by first attaching the top membrane to the egg-crate material as shown in FIG. 8 and then the egg-crate structure is generated via selective wet or dry etching. Then the black absorption layer is applied to the inside of the egg-crate and to the enclosed side of the top membrane. This assembly of membrane 12 and egg-crate spacer 14 is then attached to the optical substrate 16 and the top member is slotted with slots 18 by means of similar etching techniques. The top membrane is then attached at its corners to the spacer assembly and the spacer assembly optically blocks any radiation coming from the top layer to the region of the slots, so that such radiation cannot pass through the optical substrate without at least one bounce.

Figure 10:
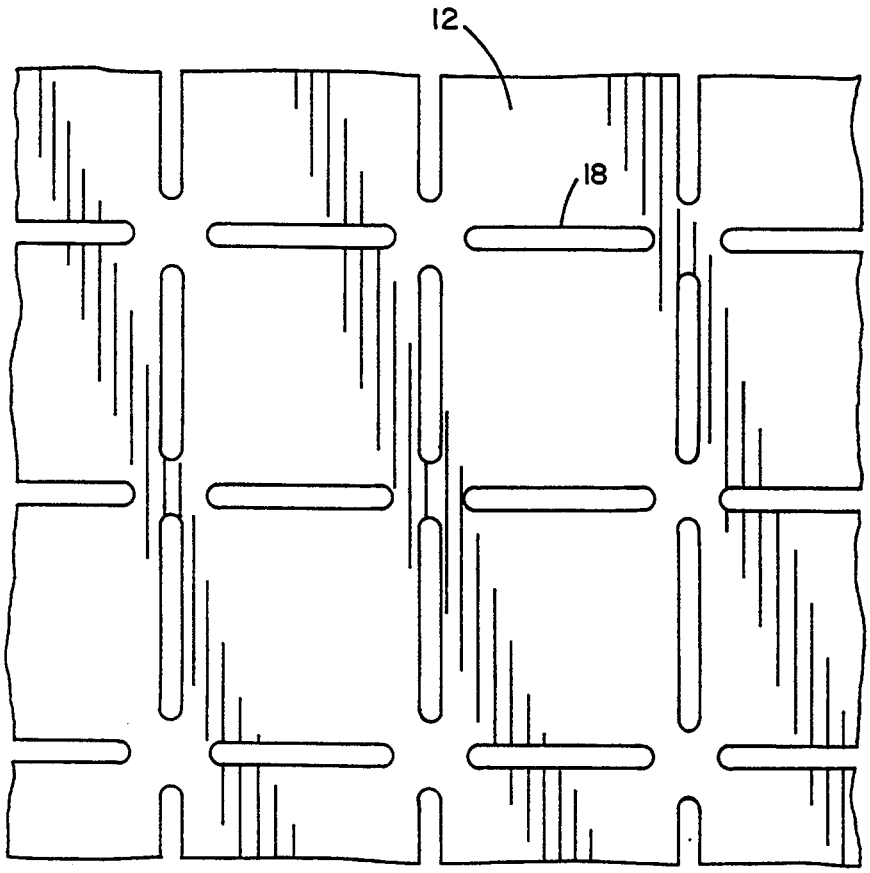
FIG. 10 is a top view of the top membrane of the air-bridge thermal screen prior to its attachment to the spacer.

The total fill factor of the completed structure is approximately 80%. Finally, the top surface of the top membrane, that is the surface facing away from the egg-crate spacer assembly, is coated with the highly reflective and electrically conductive layers. A top view of the top membrane, shown connected to the spacer, is provided in FIG. 9 and a top view of the top membrane disconnected from the top spacer is shown in FIG. 10. The top membrane is both mechanically and thermally attached to the egg-crate structure and the open slots 18 seen best in FIG. 10, are provided to thermally isolate the membrane from the spacer assembly. During construction, the top membrane is attached to the spacer (i.e., gluing or grown on) prior to any slotting of the top layer and prior to the egg-crate etching of the spacer.

Figure 4:
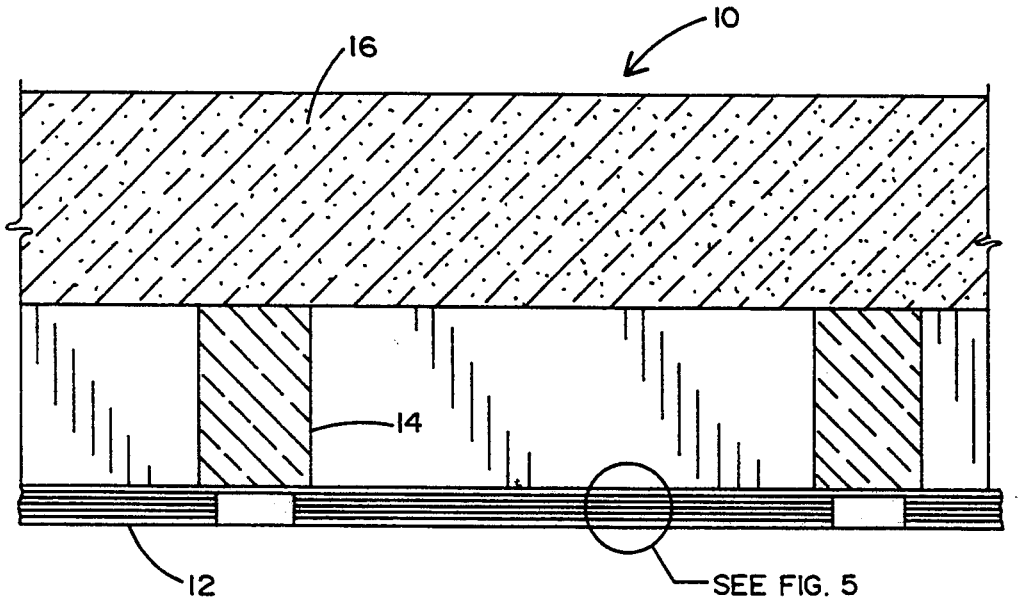
FIG. 4 is a highly enlarged side view of the air-bridge thermal screen of the present invention.

Upon completion of the aforementioned fabrication process, the air-bridge thermal screen has the configuration shown in side view in FIG. 4 and comprises a top layer 12 having a thickness of less than 5 microns, a spacer 14 having a thickness of approximately 0.1 millimeters and an underlying optically transparent substrate 16 having a thickness of approximately 6 millimeters and having anti-reflective coating on both surfaces.

Figure 11:
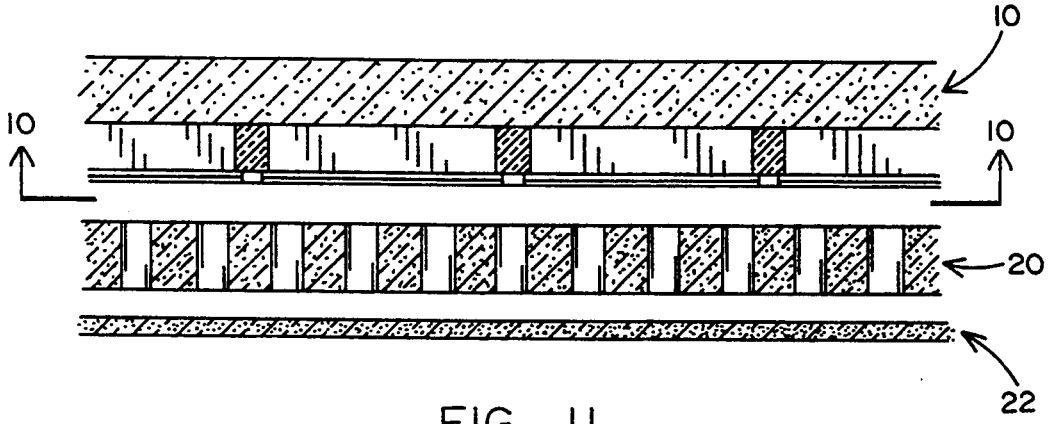
FIG. 11 is a general layout drawing of the thermal scene generator of the present invention, illustrating the various dimensions and relative spacing between the respective components thereof.

The completed assembly of photo-cathode, micro-channel plate and air-bridge thermal screen is illustrated in FIG. 11. As seen therein, the top of the assembly is the output side of the scene generator and comprises the optically transparent substrate of the air-bridge thermal screen. As seen further in FIG. 11, a gap of approximately 1 millimeter separates the air-bridge thermal screen 10 from the micro-channel plate 20, which is in turn separated from the photo-cathode 22 by approximately 0.1 millimeters. The overall diameter of the assembly is approximately 50 millimeters in the preferred embodiment.

It will now be understood that what has been disclosed herein comprises a high resolution infrared scene simulator formed by a novel combination of a photo-cathode, one or more micro-channel plates and a uniquely constructed air-bridge thermal screen. The photo-cathode is used to covert photons into electrons for insertion into the input side of the micro-channel plate. The micro-channel plate is a photo-electric device comprising a parallel array of independent channel, electron multipliers capable of high gain electron amplification. The air-bridge thermal screen comprises numerous thermally isolated thin platelets, bridges or diaphragms whose individual thermal mass and resistance are respectively low and high. Such platelets are thermally isolated and are supported on a structure that is capable of being cooled and electrically conductive. The resulting novel combination is simple in construction and operation, compatible with low cost production and utilization and can operated at temperatures below 70 degree Kelvin. Furthermore, it can provide parallel processing at high data rates, thereby meeting a number of significant requirements of thermal scene generators not present in any prior art known to the applicant, but which are necessary to provide high resolution thermal scenes used as test targets for the evaluation of near-to-far infrared electro-optical sensors.

Those having skill in the relevant art, will now as a result of the applicant's disclosure herein, perceive various additions and modifications which may be made to the invention. By way of example, the specific materials, sizes and configurations disclosed herein in the form of a preferred embodiment, may be readily altered while accomplishing substantially the same result. Accordingly, all such modifications and additions are deemed to be within the scope of the invention which is to be limited only by the claims appended hereto and their equivalents.

I claim:

1. An apparatus for converting a visual or photon image into a thermal image; the apparatus comprising:

a photocathode for converting incident photons of said visual or photon image into a corresponding pattern of electrons;

an electron amplifier for receiving said pattern of electrons and generating a corresponding electron beam pattern; and means for converting said electron beam pattern into said thermal image comprising a plurality of thermally isolated pixels arrayed on a thermal imaging surface;

wherein said converting means comprises a membrane having a plurality of layers of conductive material and a plurality of layers of insulative material; and an optically transparent substrate spaced from said membrane;

said photocathode, said electron amplifier and said converting means being optically aligned and being contained in a common substantially evacuated volume.

2. The apparatus recited in claim 1 wherein said membrane and said substrate are spaced from one another by an egg-crate-shaped spacer made of electrically conductive material and configured for defining the borders of said pixels.

3. The apparatus recited in claim 2 wherein said membrane has a first surface facing said spacer and a second surface facing said electron amplifier; said first surface having an absorptance greater than about 0.8.

4. The apparatus recited in claim 2 wherein said membrane is substantially slotted where it contacts said spacer.

5. The apparatus recited in claim 2 wherein said membrane is about 5 $\mu$m thick, said spacer is about 0.1 mm thick and said substrate is about 6 m thick.

6. The apparatus recited in claim 1 wherein said electron amplifier comprises at least one microchannel plate.

7. The apparatus recited in claim 1 wherein said substrate has its exterior surfaces coated with an anti-reflective material.

8. The apparatus recited in claim 1 wherein said layers of conductive material comprise an exterior layer of gold and an underlying layer of tungsten and wherein said insulative layers comprise layers of silicon nitride and silicon oxynitride.

9. The apparatus recited in claim 1 wherein said electron amplifier has an electron gain of at least $10^4$.

10. The apparatus recited in claim 1 wherein said membrane has a first exterior surface facing toward said substrate and a second exterior surface facing away from said substrate; said first exterior surface being made of an optically black material and said second exterior surface being made of an optically reflective material.

11. The apparatus recited in claim 10 wherein said black material is cupric oxide and said reflective material is gold.

* * * * *